US005168598A

United States Patent [19]

Hashizume et al.

[11] Patent Number: 5,168,598

[45] Date of Patent: Dec. 8, 1992

[54] UPRIGHT VACUUM CLEANER

[75] Inventors: Kiyoshi Hashizume; Hiroshi Nishimura, both of Shiga, Japan

[73] Assignee: Matsushita Electric Industrial Co., Ltd., Osaka, Japan

[21] Appl. No.: 804,375

[22] Filed: Dec. 10, 1991

[30] Foreign Application Priority Data

Dec. 10, 1990 [JP] Japan ..... 2-400246[U]

[51] Int. Cl.[5] ..... A47L 9/26

[52] U.S. Cl. ..... 15/323; 15/351

[58] Field of Search ..... 15/323, 350, 351

[56] References Cited

U.S. PATENT DOCUMENTS 2,633,596 4/1953 Turner et al. ..... 15/323
2,672,642 3/1954 Tamarin et al. ..... 15/323
2,974,343 3/1961 Seyfried ..... 15/323
3,029,462 4/1962 Tamarin ..... 15/323
4,905,341 3/1990 Sunagawa ..... 15/323

*Primary Examiner*—Chris K. Moore
*Attorney, Agent, or Firm*—Wenderoth, Lind & Ponack

[57] ABSTRACT

An upright vacuum cleaner which includes a floor nozzle portion having a rotary brush incorporated in it, a dust collecting portion incorporated with an electric blower tiltably provided on the floor nozzle portion, a cord winding device mounted at a rear face side of the dust collecting portion, moving rollers rotatably mounted at opposite ends of one main shaft, and a cover member for covering the cord winding device from the rear face side, with the main shaft of the rollers being held between the dust collecting portion and the cover member.

10 Claims, 8 Drawing Sheets

UPRIGHT VACUUM CLEANER

BACKGROUND OF THE INVENTION

The present invention generally relates to a cleaner and more particularly, to an upright vacuum cleaner having a cord winding device.

Generally, the upright vacuum cleaner of this kind has constructions as shown in FIGS. 9 and 10, and includes a floor nozzle portion 1 in which a rotary brush 2 is incorporated, a dust collecting portion 3 tiltably mounted, on the floor nozzle portion 1 and having an electric fan 4 incorporated therein, a cord winding device 5 mounted at a back face of said dust collecting portion 3, a cover member 6 for the cord winding device 5, and a set of rollers 7 for displacement provided at opposite lower edges of the dust collecting portion 3 via a shaft 8 extending through bearing holes 3*a* formed at said lower edge of the dust collecting portion 3. The shaft 8 is provided with E-rings 9 set in grooves 8*a* thereof for preventing disengagement of said rollers 7 therefrom, and spacers 10 as shown in FIG. 10.

However, in the known constructions as described above, when the rollers 7 are to be mounted on the roller shaft 8, at least at one side, the roller 7 must be fitted onto the roller shaft 8 after passing said roller shaft 8 through the bearing hole 3*a*, and further, the E-rings 9 are required to be fitted into the grooves 8*a* of the roller shaft 8 in the above state.

Accordingly, when the rollers 7 are to be attached onto the shaft 8, it becomes necessary to displace the dust collecting portion 3, which is a large component, to other places, or to carry out assembly work in an unnatural state to avoid such displacement of the component.

Particularly, since it has been a general practice to arrange the opposite ends of the roller shaft 8 not to project from end faces of the rollers 7 as shown in FIGS. 9 and 10 to prevent damages to furniture or the like, attachment of the E-rings inevitably becomes a difficult work.

Moreover, since the bearing holes 3*a* formed at the lower edge portion of the dust collecting portion 3 is generally communicated with a motor chamber in which the motor 4 is disposed, such bearing holes 3*a* tend to provide averse effects such as leakage of exhaust air and consequent generation of noises.

Furthermore, in the case of a trouble such as disengagement of connections for lead wires, etc. within the motor chamber, since the roller shaft 8 extends through the motor chamber, there is a possibility that the disengaged lead wires contact the roller shaft 8, thus also involving a problem related to safety such as electric shock to an user through the shaft 8, etc.

Additionally, in order to impart sufficient strength for the bearing holes 3*a* or to facilitate the work for passing the roller shaft 8 through said bearing holes 3*a*, it is so arranged, in many cases, to provide another bearing hole at an intermediate portion between the two holes 3*a* at the opposite sides as shown in FIG. 10, thereby to partially expose the roller shaft 8 externally, and in this case, there is such an inconvenience that the exposed portion of the roller shaft 8 tends to be caught by some items projecting from the floor surface.

SUMMARY OF THE INVENTION

Accordingly, an essential object of the present invention is to provide an upright vacuum cleaner which is simple in construction, and can be readily assembled during manufacture in an efficient manner.

Another object of the present invention is to provide an upright vacuum cleaner of the above described type which is free from adverse effects such as leakage of exhaust air, generation of noises, electric shock to an user, or possibility of being caught by projecting items on a floor, etc.

In accomplishing these and other objects, according to one aspect of the present invention, there is provided an upright vacuum cleaner which includes a floor nozzle portion having a rotary brush incorporated therein, a dust collecting portion incorporated with an electric blower tiltably provided on the floor nozzle, a cord winding device mounted at a rear face side of the dust collecting portion, moving rollers rotatably mounted at opposite ends of one main shaft, and a cover member for covering the cord winding device form the rear face side. The main shaft of the rollers is arranged to be held between the rear face side of said dust collecting portion and said cover member.

In another aspect of the present invention, in addition to the above arrangement for holding the roller main shaft between the rear face side of the dust collecting portion and the cover member for the cord winding device, the main shaft for the rollers is formed with a flattened recess portion approximately at its central portion, while the dust collecting portion is formed, at its rear face side in a position corresponding to the recess portion, with a rib portion for holding the recess portion therein.

In a further aspect of the present invention, in addition to the arrangement for holding the roller main shaft between the rear face side of the dust collecting portion and the cover member for the cord winding device, the main shaft is formed with a projection partially extending outwardly from the peripheral face at approximately a central portion of the main shaft, while the dust collecting portion is formed, at its rear face side in a position corresponding to the projection of the main shaft, with a rib portion for holding the outer peripheral face of said main shaft therein.

In still another aspect of the present invention, in addition to the arrangement which provides the recess portion or projection at approximately the central portion of said roller main shaft, the opposite ends of said main shaft is adapted to be held by bearing portions provided at the rear face side of said dust collecting portion and said cover member.

In a further aspect of the present invention, the cover member for covering the cord winding device form the rear face side is provided, at its lower portion, with a protrusion of an approximately semi-circular cylindrical cross section projecting rearwardly from the cover member, with the main shaft for the rollers as a center, and extending along an approximately entire region between said two rollers.

By the arrangement according to the present invention as described so far, the work for passing the main shaft of the rollers thorough the bearing holes may be dispensed with, and it is required only to place the main shaft, with the two rollers mounted thereon, at the rear face side of the dust collecting portion, while the securing of the main shaft in position is effected simultaneously with the fixing of the cover member for the cord winding device, thus providing a marked improvement of the workability.

Moreover, since the bearing holes of the dust collecting portion are not communicated with the motor chamber, various favorable effects such as prevention of leakage of exhaust air, reduction of noises, and elimination of danger of electric shock to the user, etc. can be achieved.

Furthermore, by holding the narrow width recess portion at the central portion of the main shaft by the rib integrally formed at the rear face side of the dust collecting portion, undesirable abrasion at the bearing portions due to simultaneous rotation of the roller main shaft together with said rollers may be prevented.

In addition, since the processing to the narrow width recess portion at the central portion of the main shaft may be effected approximately at the same time with the cutting of grooves at the opposite ends of the main shaft for fixing the E-rings, cost reduction for the main shaft can be achieved, while, by forming said narrow width recess portion for rotation prevention at the central portion of the main shaft, the roller main shaft has a symmetric shape, and thus, particular attention with respect to the directivity of the main shaft is not required for improved workability.

Similarly, by holding the central portion of the main shaft provided with the projection by the rib portion, etc. having almost the same width as the outer diameter of the main shaft and integrally formed with the rear face side of the dust collecting portion, simultaneous rotation of the main shaft together with the rollers can be advantageously prevented.

Additionally, during attachment of the main shaft to the bearing portions, if the projection formed at the central portion of the main shaft contacts the rib at the bearing side, the main shaft is attached while being automatically rotated, and therefore, when the main shaft is to be incorporated, it may be simply assembled without considering the position of the projection, thereby improving workability.

Meanwhile, it has been a common practice to provide spacers at inner sides of the rollers in order to prevent the roller side end faces of the bearing portions from being worn out by the rotation of the rollers, and by providing the projection at the central portion of the main shaft, it becomes possible to prevent deviation of the spacers and rollers at one end towards the opposite side, during assembly of the main shaft mounted with the rollers and spacers, into the bearing portions, and thus, improvement of workability can also be achieved.

Furthermore, by the provision of the protrusion in the approximately semi-circular cylindrical cross section with the main shaft of the rollers at the center, since the distance from said protrusion to the floor surface is constant irrespective of tilting or inclination angles of the dust collecting portion, and the main shaft of the rollers is not exposed, such mains shaft portion is prevented from being caught by the items projecting from the floor surface.

BRIEF DESCRIPTION OF THE DRAWINGS

These and other objects and features of the present invention will become apparent from the following description taken in conjunction with the referred embodiment thereof with reference to the accompanying drawings, in which.

DETAILED DESCRIPTION OF THE INVENTION

Figure 1:
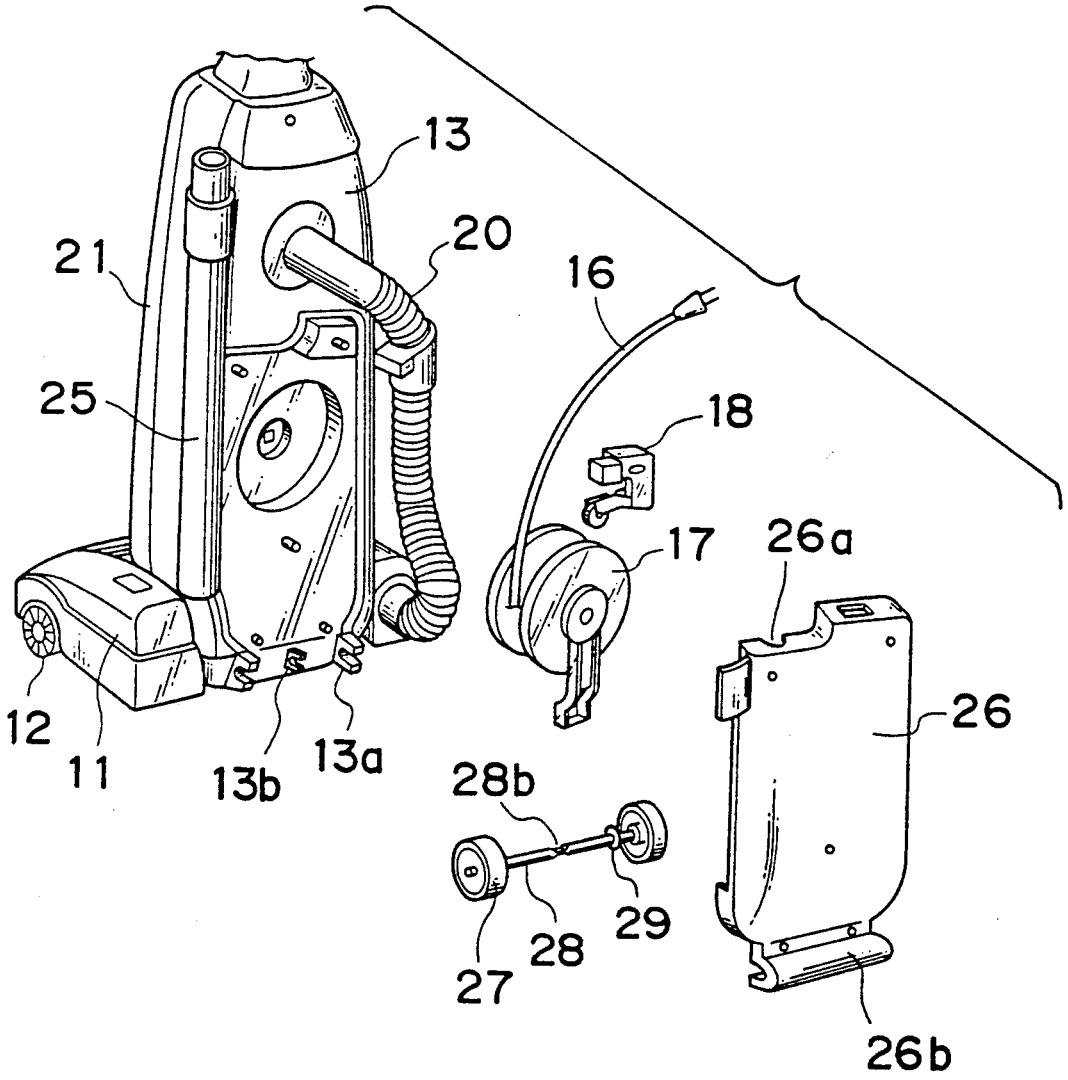
FIG. 1 is an exploded respective view of an upright vacuum cleaner according to one preferred embodiment of the present invention.

Before the description of the present invention proceeds, it is to be noted that like parts are designated by like reference numerals, throughout the accompanying drawings.

Figure 2:
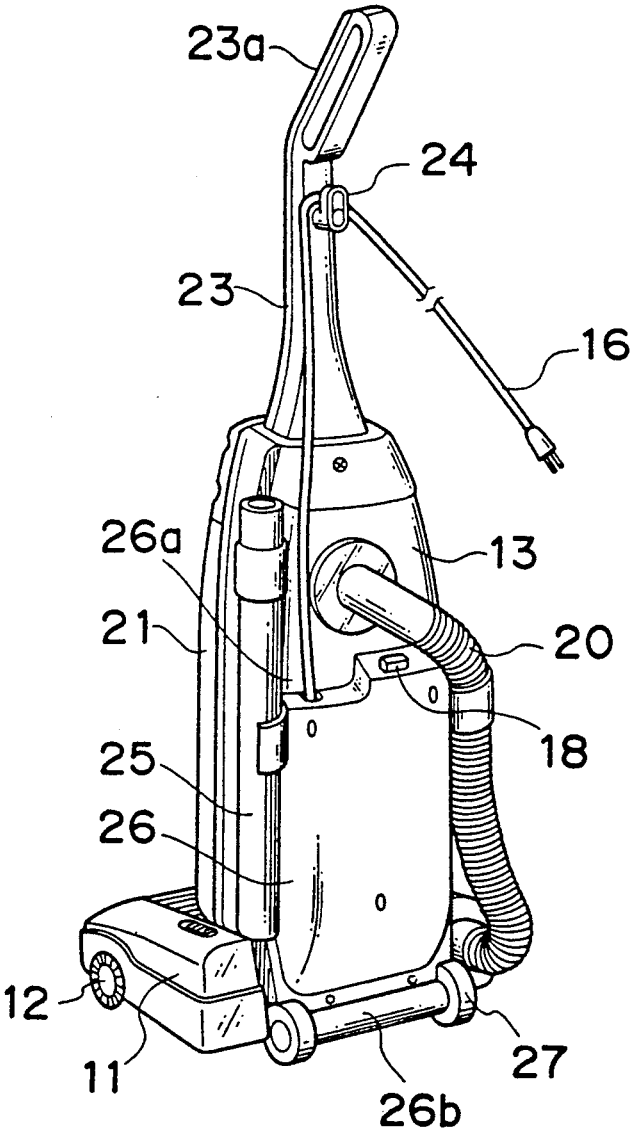
FIG. 2 is a perspective view of the upright vacuum cleaner of FIG. 1 in an assembled state.
Figure 3:
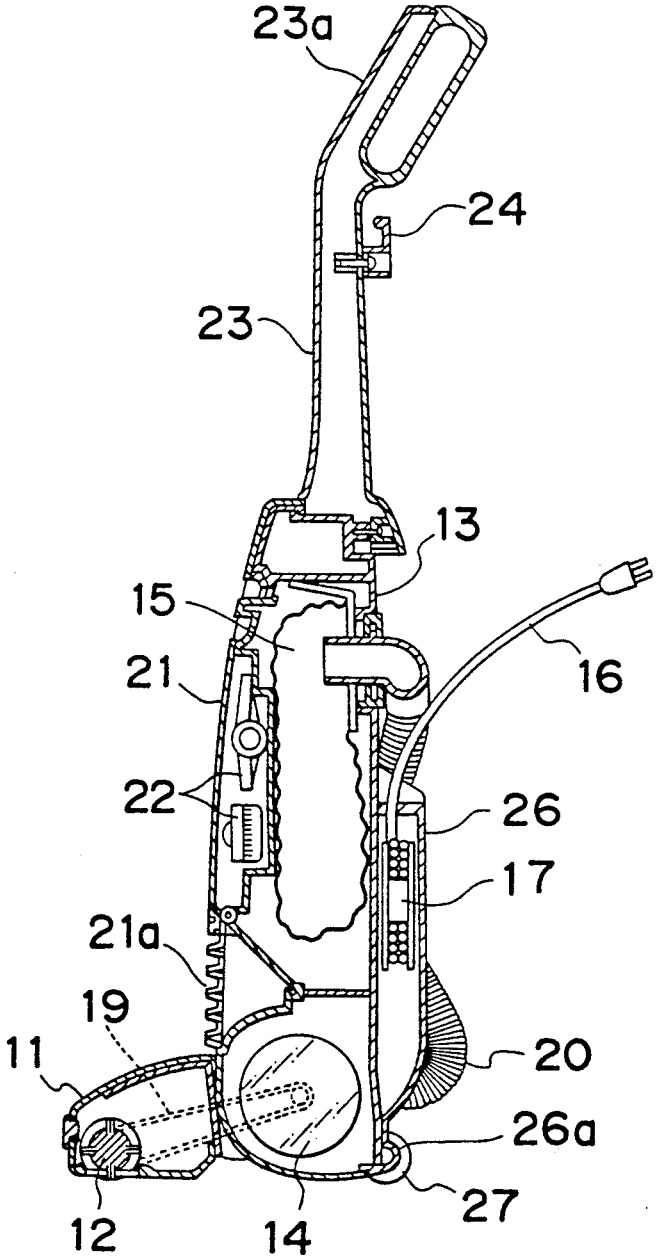
FIG. 3 is a vertical cross section of the upright vacuum cleaner of FIG. 2.

Referring now to the drawings, there is shown in FIGS. 1 to 5, an upright vacuum cleaner according to one preferred embodiment of the present invention, In FIGS. 1 to 3, the upright vacuum cleaner generally includes a floor nozzle portion 11 having a rotary brush 12 incorporated therein, a dust collecting portion 13 incorporated with an electric blower 14, etc. and tiltably provided on said floor nozzle portion 11, a cord winding device 17 mounted at a rear face side of said dust collecting portion 13, cleaner moving or displacing rollers 27 rotatably mounted at opposite ends of one main shaft 28, and a cover member 26 for covering said cord winding device 17 from the rear face side, with the main shaft 28 of said roller 27 being held between the dust collecting portion 13 and the cover member 26 when assembled.

The rotary brush 12 incorporated within the floor nozzle portion 11 functions to pick up dust and dirt.

The dust collecting portion 13 provided at the rear portion of the floor nozzle 11 for inclination as desired is incorporated with the electric blower 14 for attraction of dust, a bag 15 for dust collection, the cord winding device 17 for accommodating a cord 16, and a brake button 18 for releasing a braking device for said cord winding device 17.

The electric blower 14 is connected to the rotary brush 12 through a belt 19, while the floor nozzle portion 11 and the dust collecting portion 13 are connected to each other by a detachable hose 20.

The dust collecting portion 13 is provided at its front face side, with a detachable lid 21 for taking out the dust collecting bag 15, and has attachment parts 22 which may be taken out as desired at its upper portion, and an exhaust port 21*a* at the lower portion thereof.

At the upper end portion of the dust collecting portion 13, there is mounted an operating handle 23, at one end of which, a grip portion 23*a* is integrally formed, with a cord hook 24 being attached to the lower portion of the grip portion 23*a*.

An extension pipe 25 is detachably mounted at the rear face side of the dust collecting portion 13, while the cover member 26 for covering or accommodating therein said cord winding device 17 has a cord lead-out portion 26*a* at its upper face, and is formed, at its lower edge portion, with a guard portion 26*b* for the main shaft 28 in a semi-cylindrical cross section.

Figure 4:
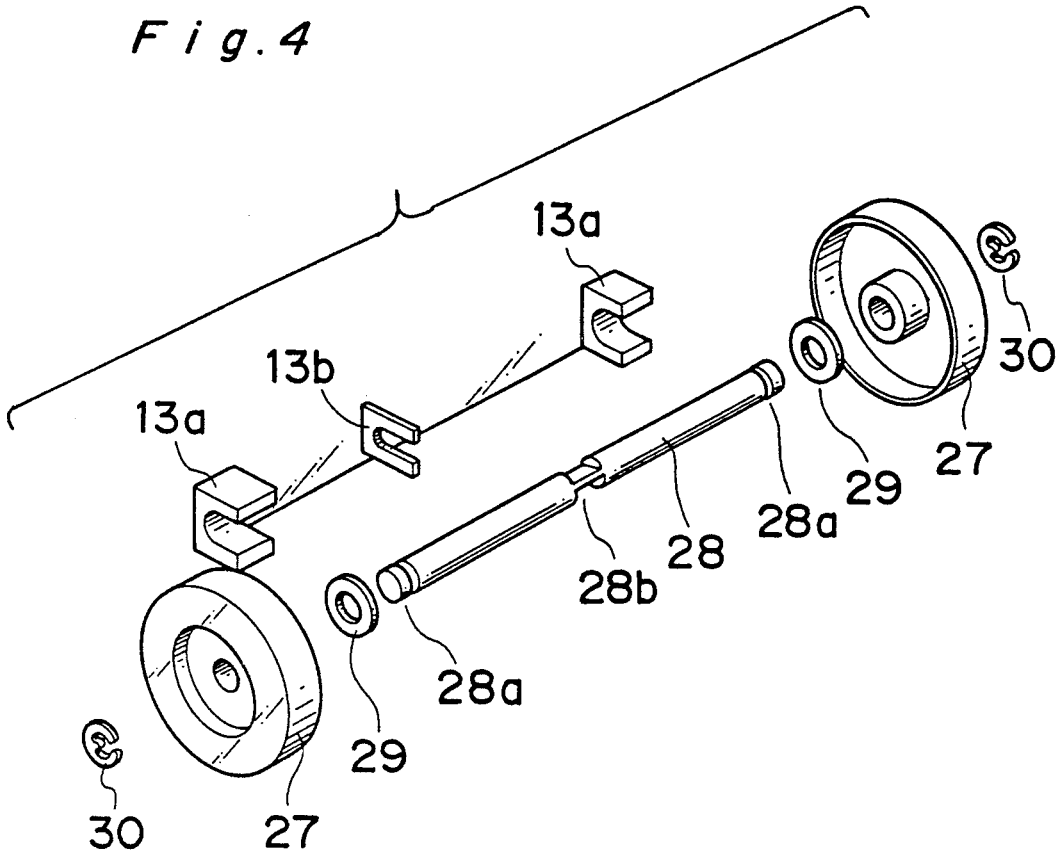
FIG. 4 is a perspective view showing on an enlarged scale, a main shaft and roller arrangement employed in the upright vacuum cleaner of FIG. 1.
Figure 5:
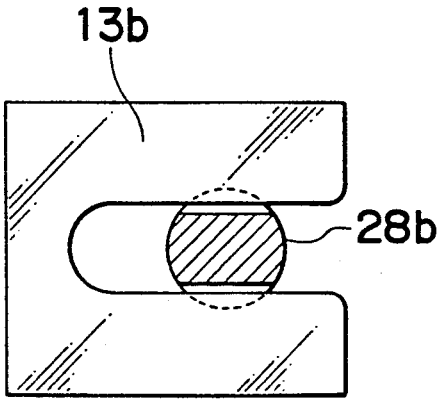
FIG. 5 is a side sectional view showing on a still enlarged scale, a flattened recess portion and a corresponding rib in the arrangement of FIG. 4, FIGS. 6 and 7 are views similar to FIGS. 4 and 5 which particularly relate to a second embodiment of the present invention.

The main shaft 28 is formed, at its central portion, with a flattened recess portion 28*b* for preventing rotation of said main shaft, and also, with E-ring fitting grooves 28*a* at its opposite ends, and has the moving rollers 27, rotatably mounted at the opposite ends thereof through spacers 29 and the E-rings 30 as illustrated in FIGS. 4 and 5.

Meanwhile, at the rear edge portion of the dust collecting portion 13, there are formed bearing portions 13*a* for receiving the main shaft 28 and a holding rib 13*b* for holding therein the flattened recess portion 28*b* for preventing rotation of said main shaft 28.

In the upright vacuum cleaner having the construction as described so far, for assembling around the rollers 27, after mounting the rollers 27, spacers 29, and E-rings 30, onto the main shaft 28, said main shaft thus assembled is fitted into the bearing portions 13*a*, while the flattened recess portion 28*b* provided at approximately the central portion of the main shaft 28 is inserted into the holding rib 13*b* referred to earlier.

By the above arrangement, the rotary brush 12 is rotated as the electric blower 14 is driven and the dust picked up thereby is attracted into the dust collecting portion 13 through the hose 20. The dust thus sucked into the dust collecting portion 13 is collected into the dust collecting bag 15, and cleaned air is discharged outside through an exhaust port 21*a*.

In the construction of the present invention as described above, mounting of the rollers 27, spacers 29, and E-rings 30 onto the main shaft 28 during assembling around the rollers 27 may be completed before incorporation of the main shaft 28 into the dust collecting portion 13, and in the above case, the E-rings 30 can be readily incorporated, since the rollers 27 are freely displaceable in the longitudinal direction.

Moreover, the main shaft 28 mounted with the rollers 27, etc., is readily fitted into the bearing portions 13*a* by merely directing the flattened recess portion 28*b* thereof for prevention of rotation to be inserted into the holding rib 13*b*, and simultaneously fixed by attaching the cover member 26 of the cord winding device 17 to the rear side of the dust collecting portion 13.

Since the rotation preventing flattened recess portion 28*b* of the main shaft 28 is formed at the central portion of said shaft, the two rollers 27 may be fitted into any of the bearing portions 13*a* at the left or right portion during insertion of the main shaft into said bearing portions 13*a*, and thus, there is no directivity for the insertion.

Furthermore, with respect to the load applied to the main shaft 28 from the floor surface through the rollers 27, since the dust collecting portion 13 is inclined or tilted in the normal state of use, most of the load is received by the bearing portions 13*a*, and any consideration for the cover member 26 in terms of strength is almost unnecessary.

Additionally, the bearing portions 13*a* may be arranged, in construction, not to be communicated with the motor chamber for accommodating the motor 14, and in the processing of the flattened recess portion 28*b* for the main shaft 28, such recess portion 28*b* may only be made smaller in the thickness than the external diameter of said main shaft for simple cutting, and can be processed in the similar manner in the processing of the grooves 28*a* for the fixing of the E-rings 30.

Figure 6:
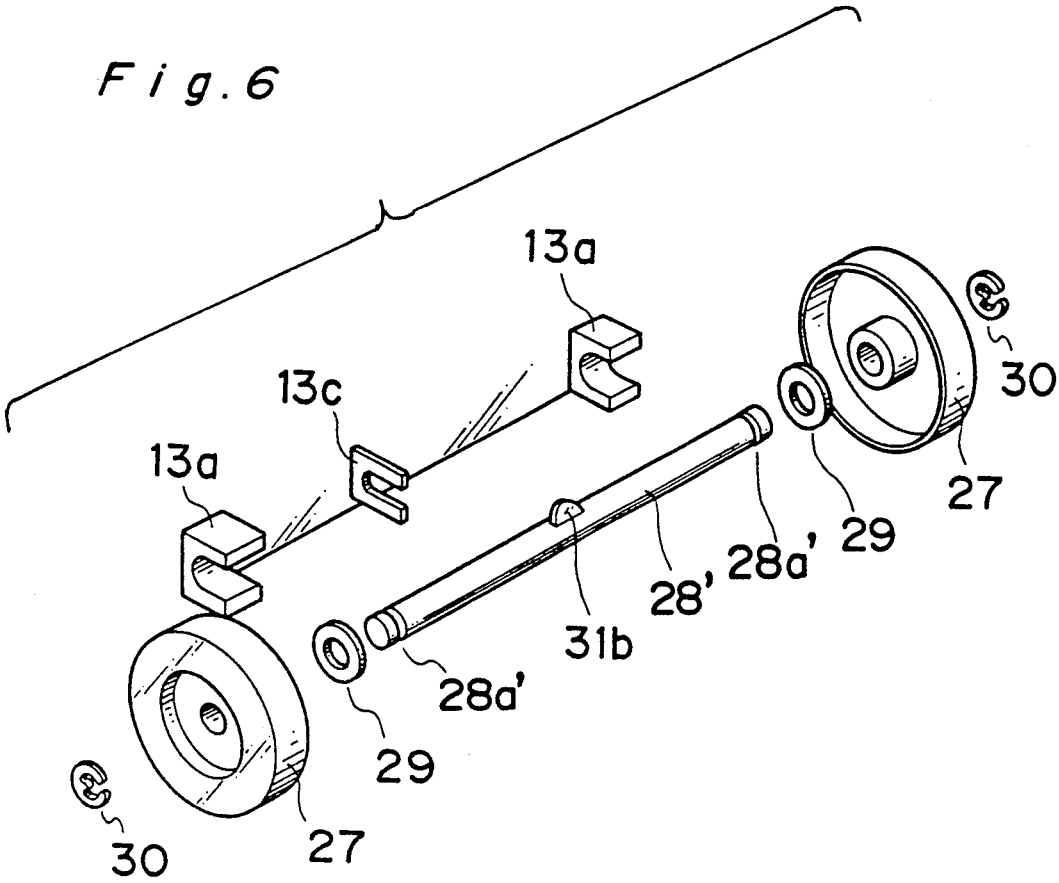
Figure 7:
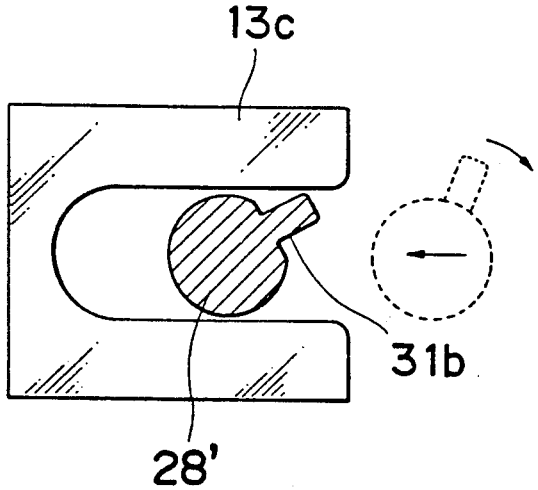

Referring further to FIGS. 6 and 7, there is shown a roller and main shaft arrangement for the upright vacuum cleaner according to a second embodiment of the present invention.

In the arrangement of FIGS. 6 and 7, the main shaft 28' is formed, at its central portion, with a rotation preventing projection 31*b* of an approximately semi-circular cross section for preventing rotation of said main shaft, and also, with E-ring fitting grooves 28*a'* at its opposite ends, and has the moving rollers 27, rotatably mounted at the opposite ends thereof through spacers 29 and the E-rings 30 in the similar manner as in the first embodiment of FIGS. 4 and 5.

Meanwhile, at the rear edge portion of the dust collecting portion 13, there are formed bearing portions 13*a* for receiving the main shaft 28*a'* and a holding rib 13*c* having a cut-out portion with a width equal to the external diameter of the main shaft 28' for holding therein the rotation preventing projection 31*b* for preventing rotation of said main shaft 28'.

In other words, in the second embodiment of the present invention as described above, the rotation preventing flattened recess portion 28*b* and the corresponding holding rib 13*b* in the first embodiment of FIGS. 4 and 5 are respectively replaced by the rotation preventing projection 31*b* and the corresponding holding rib 13*c* as shown in FIGS. 6 and 7. Since other constructions and functions of the upright vacuum cleaner of the second embodiment are similar to those of the upright vacuum cleaner of the first embodiment described earlier with reference to FIGS. 1 to 5, detailed description thereof is abbreviated here for brevity, with like parts being designated by like reference numerals.

By the above arrangement according to the second embodiment of the present invention, when the main shaft 28' is to be fitted into the bearing portions 13*a*, since the width of the cut-out portion of the holding rib 13*c* is formed to be approximately equal to the external diameter of the main shaft 28', the position of the projection 31*b* is automatically corrected upon insertion of the main shaft 28' into the bearing portions 13*a* and the holding rib 13*c* (FIG. 7).

More specifically, even if the position of the rotation preventing projection 31*b* is at the position shown by a dotted line in FIG. 7, the projection 31*b* is automatically brought into the state shown in a solid line upon insertion of the projection 31*b* into the holding rib 13*c*, and thus, it is not necessary to restrict the position of the projection 31*b* during insertion of the main shaft 28' into the bearing portions 13*a*, thereby improving efficiency for the assembling.

Furthermore, since the projection 31*b* at the central portion of the main shaft 28' extends outwardly from the outer periphery of the shaft 28', there is no possibility that the spacers 29 and roller 27 move towards the other side beyond the central portion so as to be deviated or collected at one side, and thus, the rollers 27 and the spacers 29 are rapidly separated towards the left and right sides of the main shaft 28' in an efficient manner during assembly of the main shaft 28' into the bearing portions 13*a*.

It should be noted here that, in FIG. 6, although the shape of the projection 31*b* is described as of an approximately semi-circular cross section, the configuration of the projection 31*b* is not limited to such a semi-circular cross section, but may be of any shape so far as it extends outwardly from the main shaft 28' so as to serve as the rotation preventing member, and also, prevents undesirable lateral displacement of the spacers 29 and rollers 27, thus providing the similar functions and effects.

Figure 8:
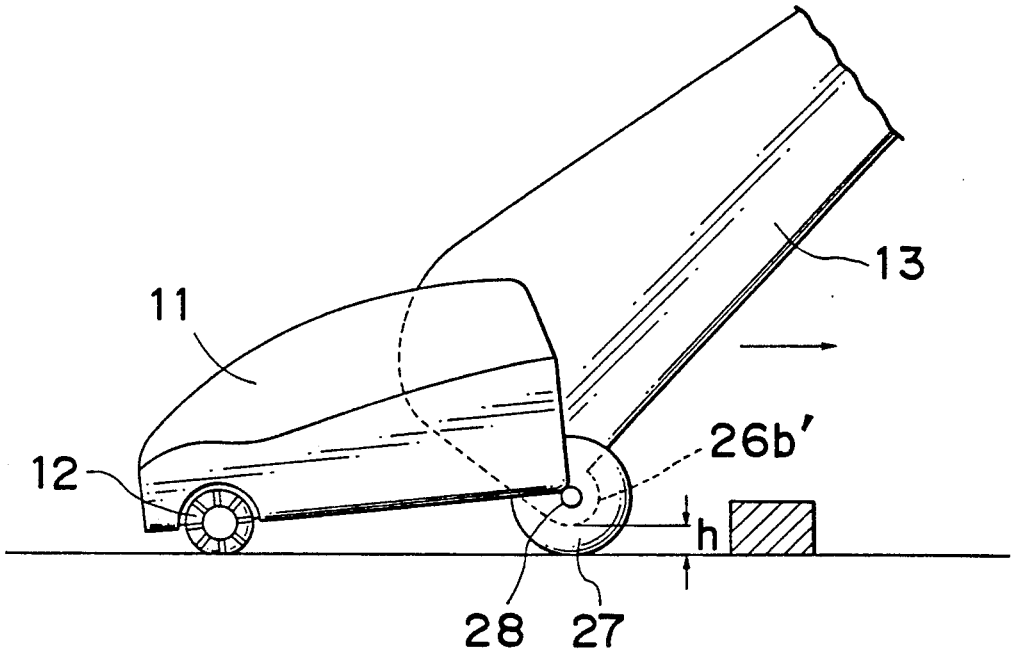
FIG. 8 is a side elevational diagram of an upright vacuum cleaner according to a third embodiment of the present invention.
Figure 9:
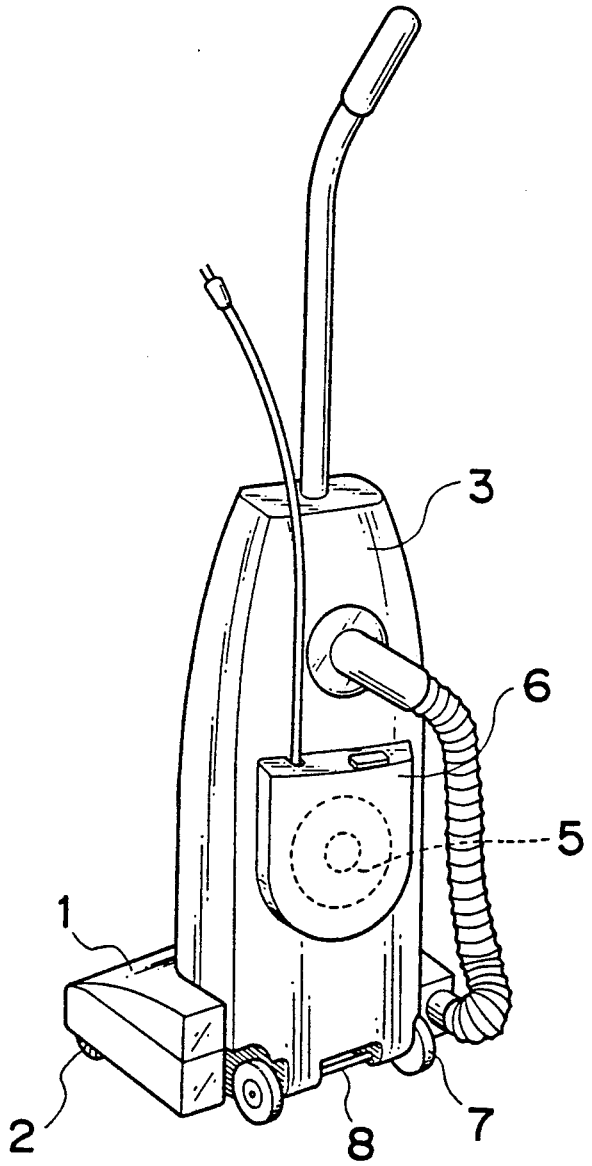
Fig. 9 PRIOR ART
FIG. 9 is a perspective view similar to FIG. 2, which particularly shows a conventional upright vacuum cleaner (already referred to)
Figure 10:
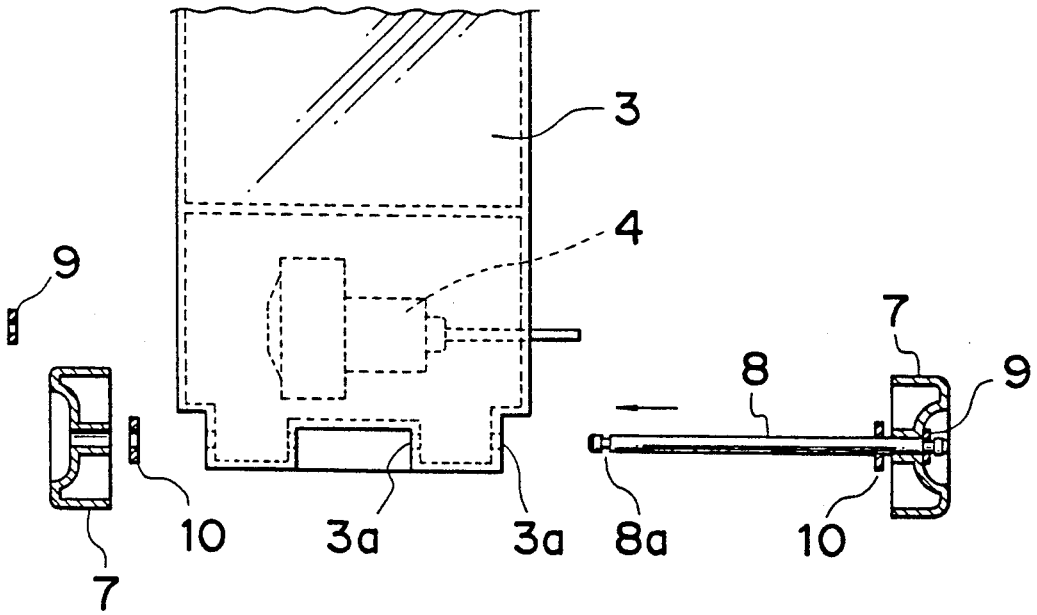
Fig. 10 PRIOR ART
FIG. 10 is a diagram for explaining the main shaft and roller arrangement for the conventional upright vacuum cleaner of FIG. 9 (already referred to).

Referring further to FIG. 8, there is shown an upright vacuum cleaner according to a third embodiment of the present invention. In this embodiment, the main shaft guard 26*b'* integrally formed at the lower portion of the cover member 26 is formed to be of a semi-circular cylindrical cross section having the main shaft 28 as a center, and therefore, it is possible to maintain a height h from the floor surface up to the peripheral edge of the main shaft guard 26*b'* constant at all times irrespective of the angles of inclination of the dust collecting portion 13. Accordingly, there is no possibility that part of the main shaft 28 or the outer periphery of the dust collecting portion 13 should contact any items projecting from the floor surface depending on the angles of inclination of the dust collecting portion 13.

Furthermore, since the main shaft guard 26*b'* is in the form of the semi-circular cylindrical cross section, it also serves as a guide to ride over the projecting item on the floor even when the height of said item is slightly higher than the height h shown in FIG. 8, thus improving applicability of the vacuum cleaner in the actual use.

As is clear from the foregoing description, in the upright vacuum cleaner according to the present invention, by the constructions in which the main shaft for the moving rollers is held between the rear face of the dust collecting portion and the cover member for the cord winding device, while the flattened recess portion or projection is provided at approximately the central portion of the roller main shaft, with a rib portion for receiving said recess portion or projection being provided at the rear face side of the dust collecting portion, and further, the protrusion of approximately the semi-circular cylindrical cross section having the main shaft as the center is provided to project rearwardly at the lower edge of the cover member so as to extend over almost the entire range between the two rollers, a marked improvement in the assembling efficiency may be realized, with simultaneous favorable effects such as reduction of noise, etc. during actual use of the vacuum cleaner.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. An upright vacuum cleaner which comprises a floor nozzle portion having a rotary brush incorporated therein, a dust collecting portion incorporated with an electric blower tiltably provided on said floor nozzle portion, a cord winding device mounted at a rear face side of said dust collecting portion, moving rollers rotatably mounted at opposite ends of one main shaft, and a cover member for covering said cord winding device from the rear face side, said main shaft of said rollers being held between said dust collecting portion and said cover member.

2. An upright vacuum cleaner as claimed in claim 1, wherein said cover member for covering said cord winding device from the rear face side is provided, at its lower portion, with a protrusion of an approximately semi-circular cylindrical cross section projecting rearwardly from said cover member, with said main shaft for the rollers as a center, and extending along an approximately entire region between said two rollers.

3. An upright vacuum cleaner which comprises a floor nozzle portion having a rotary brush incorporated therein, a dust collecting portion incorporated with an electric blower tiltably provided on said floor nozzle portion, a cord winding device mounted at a rear face side of said dust collecting portion, moving rollers rotatably mounted at opposite ends of one main shaft, and a cover member for covering said cord winding device from the rear face side, said main shaft of said rollers being held between said dust collecting portion and said cover member, said main shaft for the rollers being formed with a recess portion approximately at its central portion, said dust collecting portion being formed, at its rear face side in a position corresponding to the recess portion, with a rib portion for holding said recess portion therein.

4. An upright vacuum cleaner as claimed in claim 3, wherein said cover member for covering said cord winding device from the rear face is provided at its lower portion, with a protrusion of an approximately semi-circular cylindrical cross section projecting rearwardly from said cover member, with said main shaft for the rollers as a center, and extending along an approximately entire region between said two rollers.

5. An upright vacuum cleaner which comprises a floor nozzle portion having a rotary brush incorporated therein, a dust collecting portion incorporated with an electric blower tiltably provided on said floor nozzle portion, a cord winding device mounted at a rear face side of said dust collecting portion, moving rollers rotatably mounted at opposite ends of one main shaft, and a cover member for covering said cord winding device from the rear face side, said main shaft of said rollers being held between bearing portions provided at opposite sides on the rear face side of said dust collecting portion and said cover member, said main shaft for the rollers being formed with a recess portion approximately at its central portion, said dust collecting portion being formed, at its rear face side in a position corresponding to the recess portion, with rib portion for holding said recess portion therein.

6. An upright vacuum cleaner as claimed in claim 5, wherein said cover member for covering said cord winding device from the rear face side is provided, at its lower portion, with a protrusion of an approximately semi-circular cylindrical cross section projecting rearwardly from said cover member, with said main shaft for the rollers as a center, and extending along an approximately entire region between said two rollers.

7. An upright vacuum cleaner which comprises a floor nozzle portion having a rotary brush incorporated therein, a dust collecting portion incorporated with an electric blower tiltably provided on said floor nozzle portion, a cord winding device mounted at a rear face side of said dust collecting portion, moving rollers rotatably mounted at opposite ends of one main shaft, and a cover member for covering said cord winding device from the rear face side, said main shaft of said rollers being held between said dust collecting portion and said cover member, said main shaft for the rollers being formed with a projection partially extending outwardly from the peripheral face at approximately a central portion of said main shaft, said dust collecting portion being formed, at its rear face side in a position corresponding to said projection of said main shaft, with a rib portion for holding the outer peripheral face of said main shaft therein.

8. An upright vacuum cleaner as claimed in claim 7, wherein said cover member for covering said cord winding device from the rear face side is provided, at its lower portion, with a protrusion of an approximately semi-circular cylindrical cross section projecting rearwardly from said cover member, with said main shaft for the rollers as a center, and extending along an approximately entire region between said two rollers.

9. An upright vacuum cleaner which comprises a floor nozzle portion having a rotary brush incorporated therein, a dust collecting portion incorporated with an electric blower tiltably provided on said floor nozzle portion, a cord winding device mounted at a rear face side of said dust collecting portion, moving rollers rotatably mounted at opposite ends of one main shaft, and a cover member for covering said cord winding device from the rear face side, said main shaft of said rollers being held between said dust collecting portion and said cover member, said main shaft of said roller being held between bearing portions provided at opposite sides on the rear face side of said dust collecting portion and said cover member, said main shaft for the rollers being formed with a projection partially extending outwardly from the peripheral face at approximately a central portion of said main shaft, said dust collecting portion being formed, at its rear face side in a position corresponding to said projection of said main shaft with a rib portion for holding the outer peripheral face of said main shaft therein.

10. An upright vacuum cleaner as claimed in claim 9, wherein said cover member for covering said cord winding device from the rear face side is provided, at its lower portion, with a protrusion of an approximately semi-circular cylindrical cross section projecting rearwardly from said cover member, with said main shaft for the rollers as a center, and extending along an approximately entire region between said two rollers.

* * * * *